United States Patent [19]

Krusche

[11] Patent Number: 4,665,699

[45] Date of Patent: May 19, 1987

[54] HYDROSTATIC DRIVES

[75] Inventor: Alfred Krusche, Johannesberg, Fed. Rep. of Germany

[73] Assignee: Linde Aktiengesellschaft, Wiesbaden, Fed. Rep. of Germany

[21] Appl. No.: 672,833

[22] Filed: Nov. 19, 1984

Related U.S. Application Data

[63] Continuation of Ser. No. 324,409, Nov. 24, 1981.

[51] Int. Cl.[4] ..... F15B 13/42

[52] U.S. Cl. ..... 60/452; 60/459; 91/433

[58] Field of Search ..... 60/450, 452, 459; 91/433

[56] References Cited

U.S. PATENT DOCUMENTS

| | | | |
|---|---|---|---|
| 2,238,061 | 4/1941 | Kendrick | 103/37 |
| 2,892,312 | 6/1959 | Allen et al. | 60/52 |
| 3,878,679 | 4/1975 | Stevenpiper | 60/422 |
| 3,935,707 | 2/1976 | Murphy et al. | 60/444 |
| 4,041,983 | 8/1977 | Bianchetta | 91/433 |
| 4,087,968 | 5/1978 | Bianchetta | 60/445 |

FOREIGN PATENT DOCUMENTS 2440251 8/1974 Fed. Rep. of Germany .

OTHER PUBLICATIONS

Olhydraulik und pneumatik (1959), pp. 244–245.
Olhydraulik und pneumatik 22 (1978), No. 6, p. 339.
Olhydraulik und pneumatik 19 (1975), No. 8, p. 605.

*Primary Examiner*—Robert E. Garrett
*Assistant Examiner*—John M. Husar
*Attorney, Agent, or Firm*—Buell, Ziesenheim, Beck & Alstadt

[57] ABSTRACT

A hydrostatic drive with a pump is provided having a delivery line coming from the latter, to which at least one consumer is connected through a branch line, and an adjustable restrictor in the branch line, where the adjusting element of the restrictor is loaded on one side by an arbitrarily regulatable pressure, the improvement comprising means whereby the adjusting element of the restrictor is loaded on the other side by the pressure in the branch line between the restrictor and the consumer.

5 Claims, 10 Drawing Figures

133
111
110
85
75
74
27
179
230
156

HYDROSTATIC DRIVES

This application is a continuation of my copending application Ser. No. 324,409 filed Nov. 24, 1981.

This invention relates to hydrostatic drives and particularly to a hydrostatic drive with a pump and with a delivery line coming from the latter and to which at least one consumer is connected through a branch line, and with an adjustable restrictor in the branch line, where the adjusting element of the restrictor is loaded by a pressure that is arbitrarily regulatable, e.g., by means of a control pressure pick-off. In the systems of this type known to date the opening gap width of the restrictor is determined exclusively by the size of the arbitrarily selected control pressure. Thus, the stream flowing to the consumer and, consequently, the speed of movement of the consumer are also determined only by this control pressure. Most of the consumers used in practice have a characteristic at which the speed of movement determines the pressure of the pressure medium flowing to the consumer. There are however applications where it is desirable that only a predetermined force or torque develops at the consumer, i.e., the pressure medium flows to the consumer only with a quite specific pressure.

In order to have the pressure medium flow to the consumer with a quite specific pressure, it is known in drives with an adjustable pump for the adjusting element of the pump to be loaded by the delivery pressure so that with increasing delivery pressure the pump is set to a smaller stroke volume per revolution and thus a smaller stream. With the said normal characteristic of the consumer the pressure also decreases in the case of a smaller stream, such that the pressure medium is made to flow to the consumer with a specific preselected pressure by means of this control mechanism.

Such a control mechanism is not applicable if the adjusting element of the pump is designed so that it cannot be loaded directly by the delivery pressure of the pump.

The invention proposes a hydrostatic drive in which the pressure medium flows to the consumer with a preselected pressure even though the setting imposed on the pump is independent of the consumer pressure.

This problem is solved in accordance with the invention in that the ad3usting element of the restrictor, on the other hand, is loaded by the pressure in front of the consumer. With increasing pressure in front of the consumer, this pressure counteracts the arbitrarily imposed control pressure and thus constricts the restrictor so that the stream decreases and thus the pressure again drops on the basis of the characteristic of the consumer, where it also occurs that the throttling action and thus the pressure gradient at the restrictor are also increased through the constriction of the restrictor opening.

For a consumer that can be acted upon by pressure in both directions, that is, is capable of moving in both directions under the effect of pressure, it is provided according to an expedient embodiment of the invention that the restrictor be designed as a 4-connection/3-position valve, where the delivery line coming from the pump is connected to one connection, a return line is connected to one connection, and the two connections of the consumer are connected to the two other connections of the said valve, and where a pressure chamber is located on each side of the valve element, which is connected with an arbitrarily actuatable control pressure pick-off, and a second pressure chamber is located on each side of the valve, which is connected with the branch line, which is under pressure when the valve element is regulated to that side, between the restrictor and the consumer, such that the pressure acting in this branch line in front of the consumer counteracts the arbitrarily selected control pressure.

In another expedient embodiment of the invention, a by-pass line is provided from the two branch lines between the restrictor and the consumer and it is connected to the return line and in which a check valve opening toward the consumer is located; the latter check valve facilitates resuction into the consumer. In addition to or instead of it, it can be provided in another expedient embodiment that a drain line is connected to each of the two branch lines connected with the consumer and coming from the 4-connection/3-position valve that forms the estrictor, in which the drain line a relief valve jet regulated by the pressure in the branch line is located and protects the consumer against overloading and opens especially in the case of pressure surges at the consumer.

The application of the invention is particularly expedient in a drive system with one pump and several consumers acted upon by it, in which case the adjusting element of the pump is acted upon by the pressure gradient at the restrictor. In such a drive system it is provided in accordance with another expedient embodiment that a control pressure line leading to the adjusting element of the pump branches off from the branch line between the restrictor and the consumer; it leads to the adjusting element of the pump and conveys the pressure beyond the restrictor onto the adjusting element of the pump, and a check valve opening toward the adjusting element of the pump is located in it so that only the highest consumer pressure acts on the adjusting element of the pump as the pressure that determines the pressure gradient.

The above system can be used particularly advantageously in connection with a drive system in which an adjustable parallel-connecting restrictor is located in the branch line to at least one other consumer and whose adjusting element is acted upon on one side by the pressure in the control line and on the other side by the pressure in front of this parallel-connecting restrictor, in which case the pressure in the control pressure line in the manner described through check valves is the pressure that acts on the consumer with the maximum pressure.

It is particularly expedient if the restrictor according to the invention or the 4-connection/3-position valve constructed as it, and/or the relief valve jet or jets are located in the immediate vicinity of the consumer and are preferably combined into one control unit that is attached to the consumer.

In the foregoing general description of my invention, I have set out certain objects, purposes and advantages of the same. Other objects, purposes and advantages of this invention will be apparent from a consideration of the following description and the accompanying drawings in which.

Figure 1:
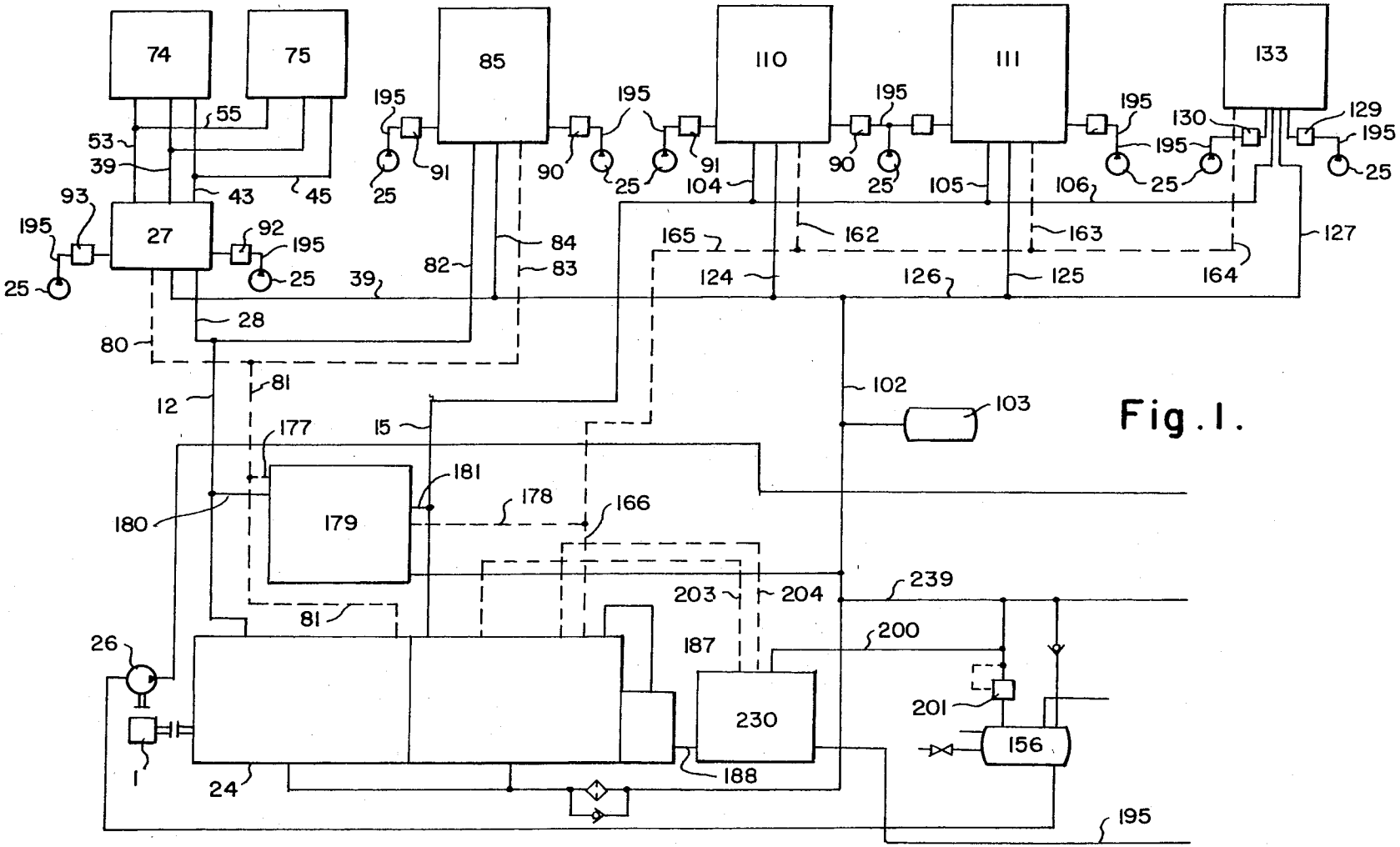
FIG. 1 shows an overall circuit diagram of a system according to my invention with the individual components indicated only in rough outline.
Figure 2:
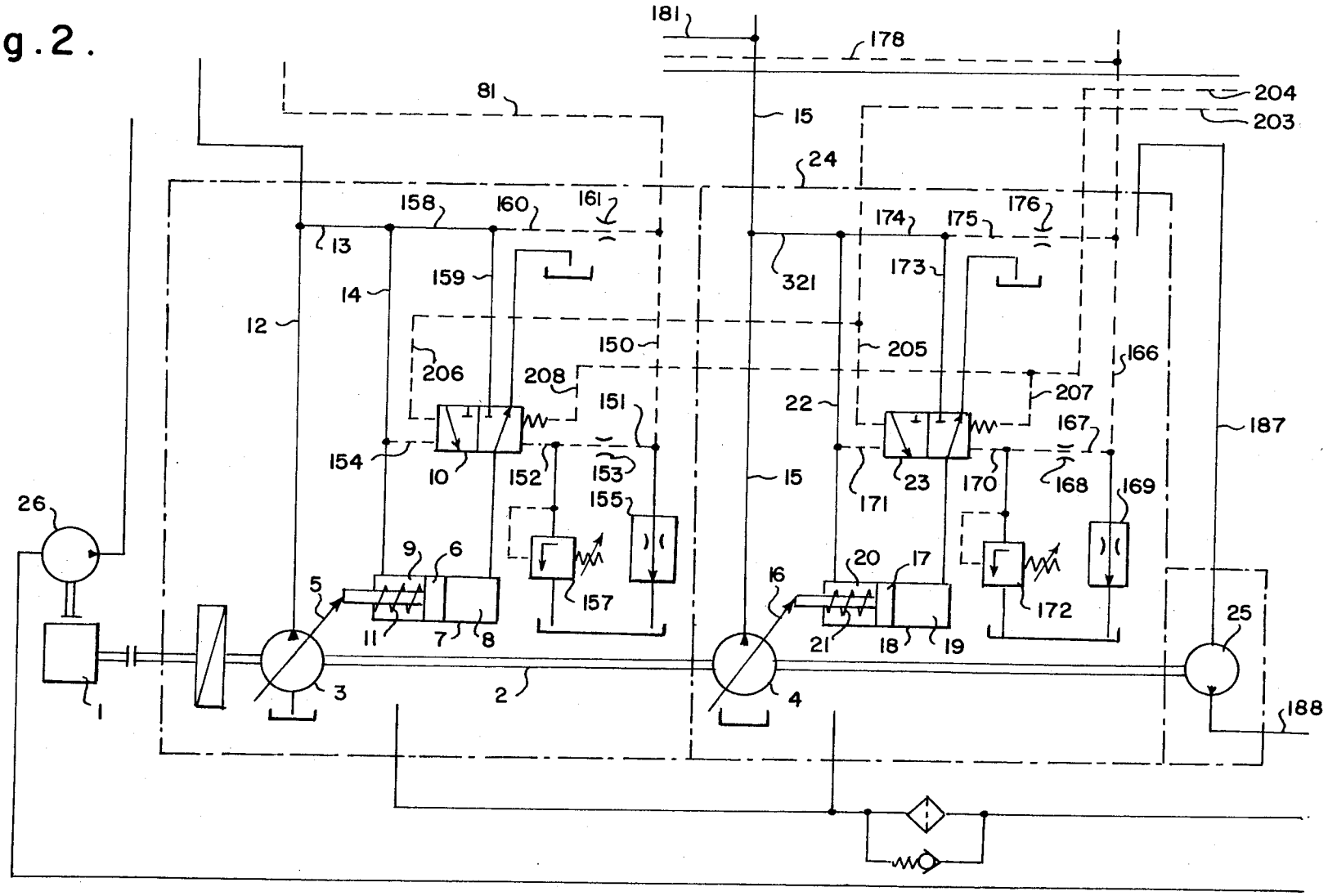
FIG. 2 shows the circuit diagram for the double-pump unit used in FIG. 1.
Figure 3:
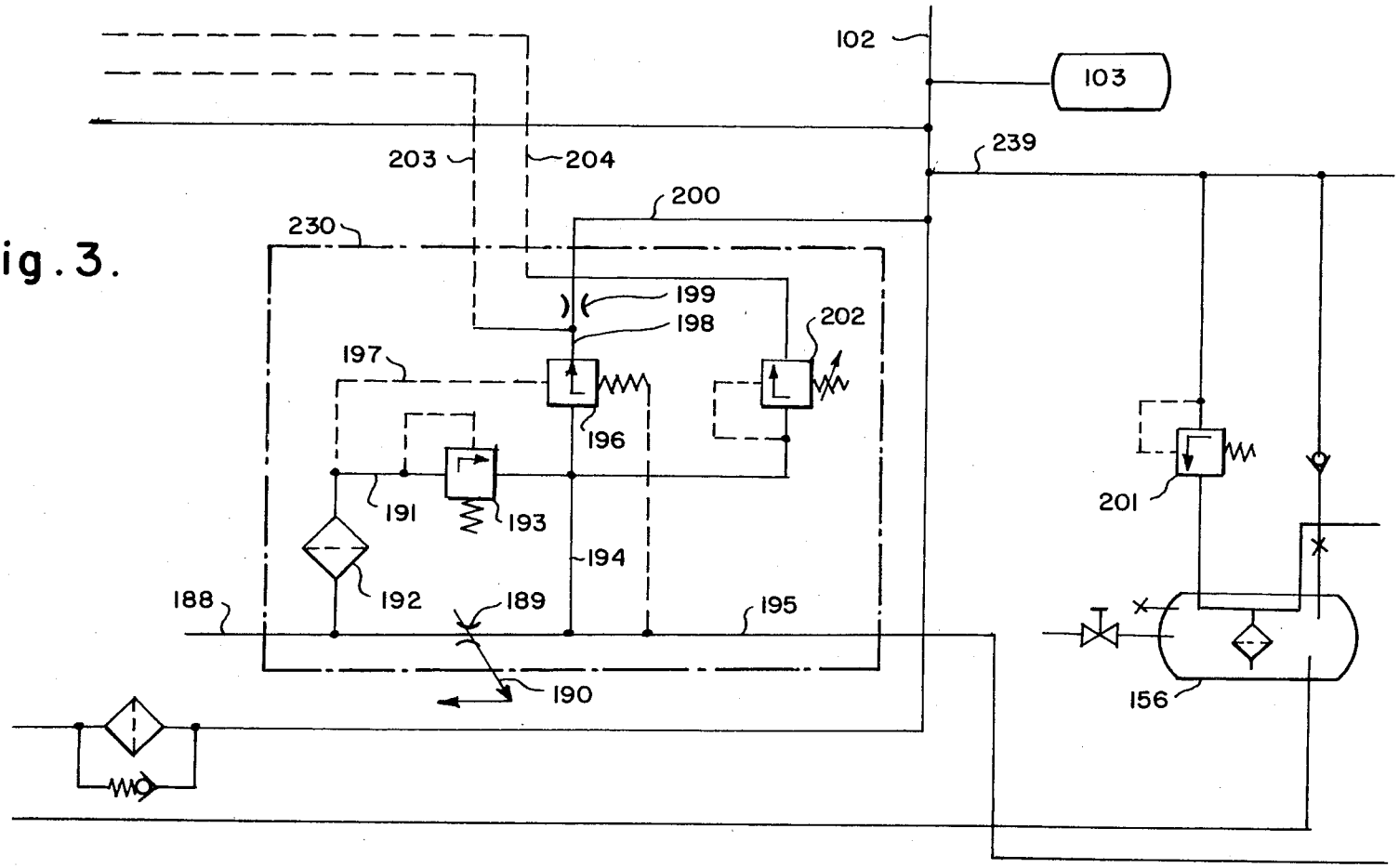
FIG. 3 shows the circuit diagram for the maximum-load control unit used in FIG. 1.
Figure 4:
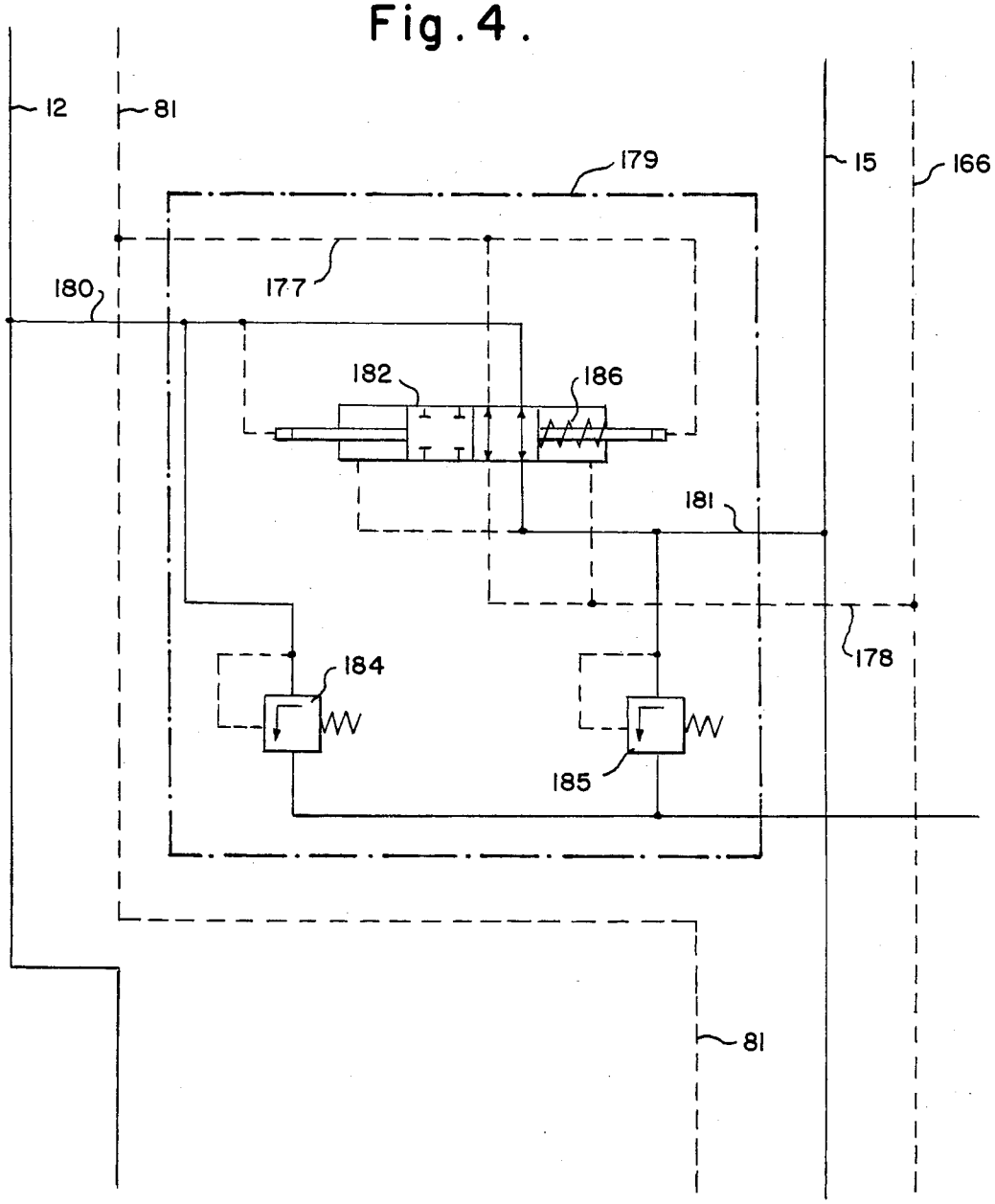
FIG. 4 shows the circuit diagram for the coupling unit used in FIG 1.
Figure 5:
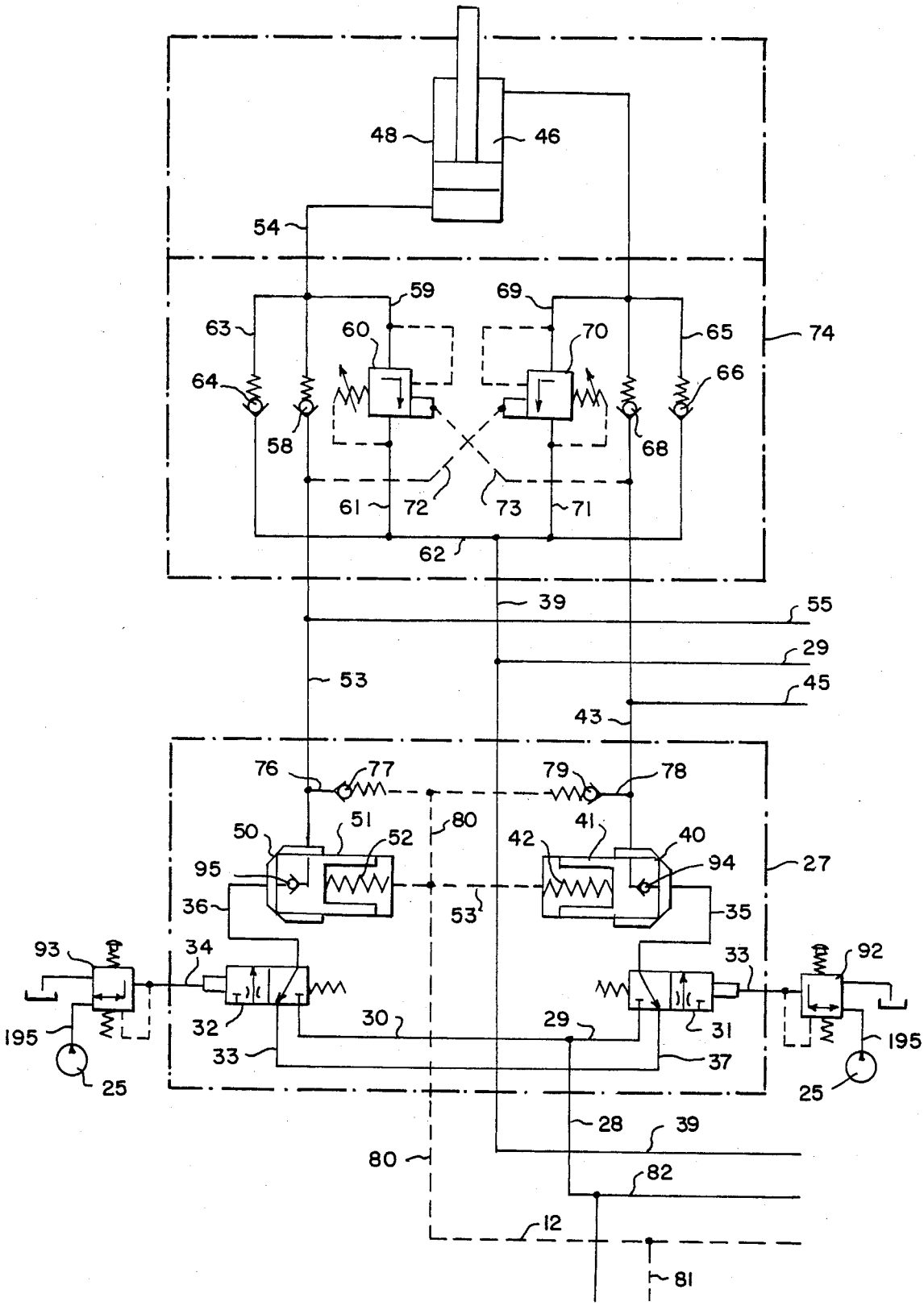
FIG. 5 shows the circuit diagram for the component control unit used in FIG. 1 for the control unit.
Figure 6:
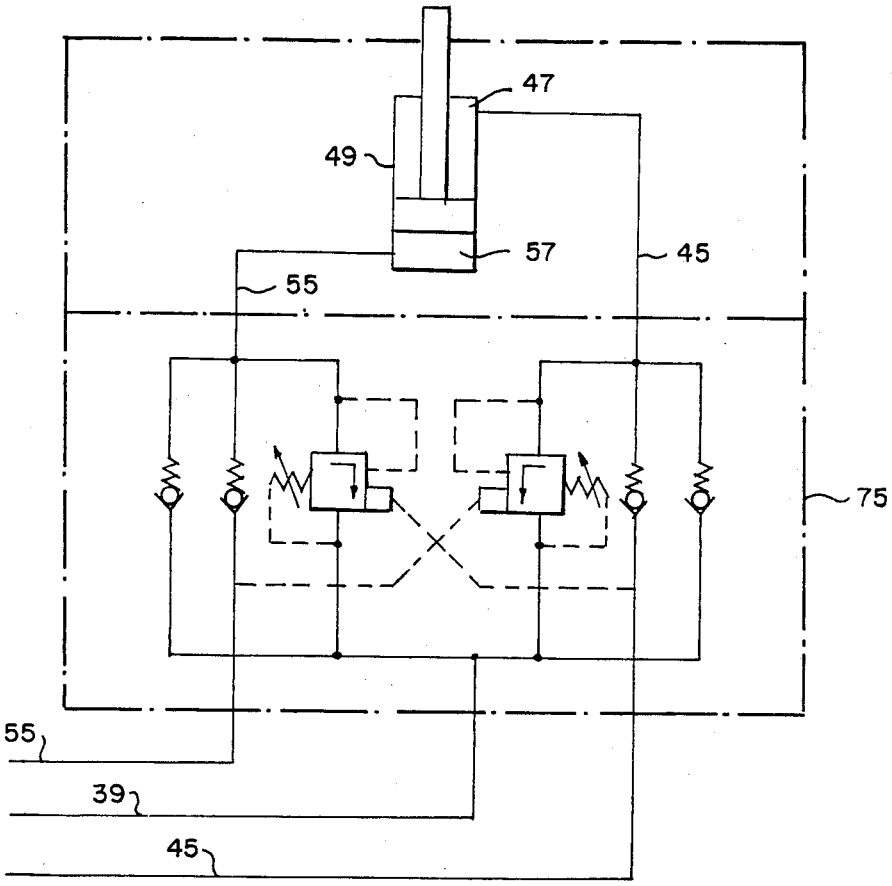
FIG. 6 shows the circuit diagram for the control unit with or without an assigned consumer.
Figure 7:
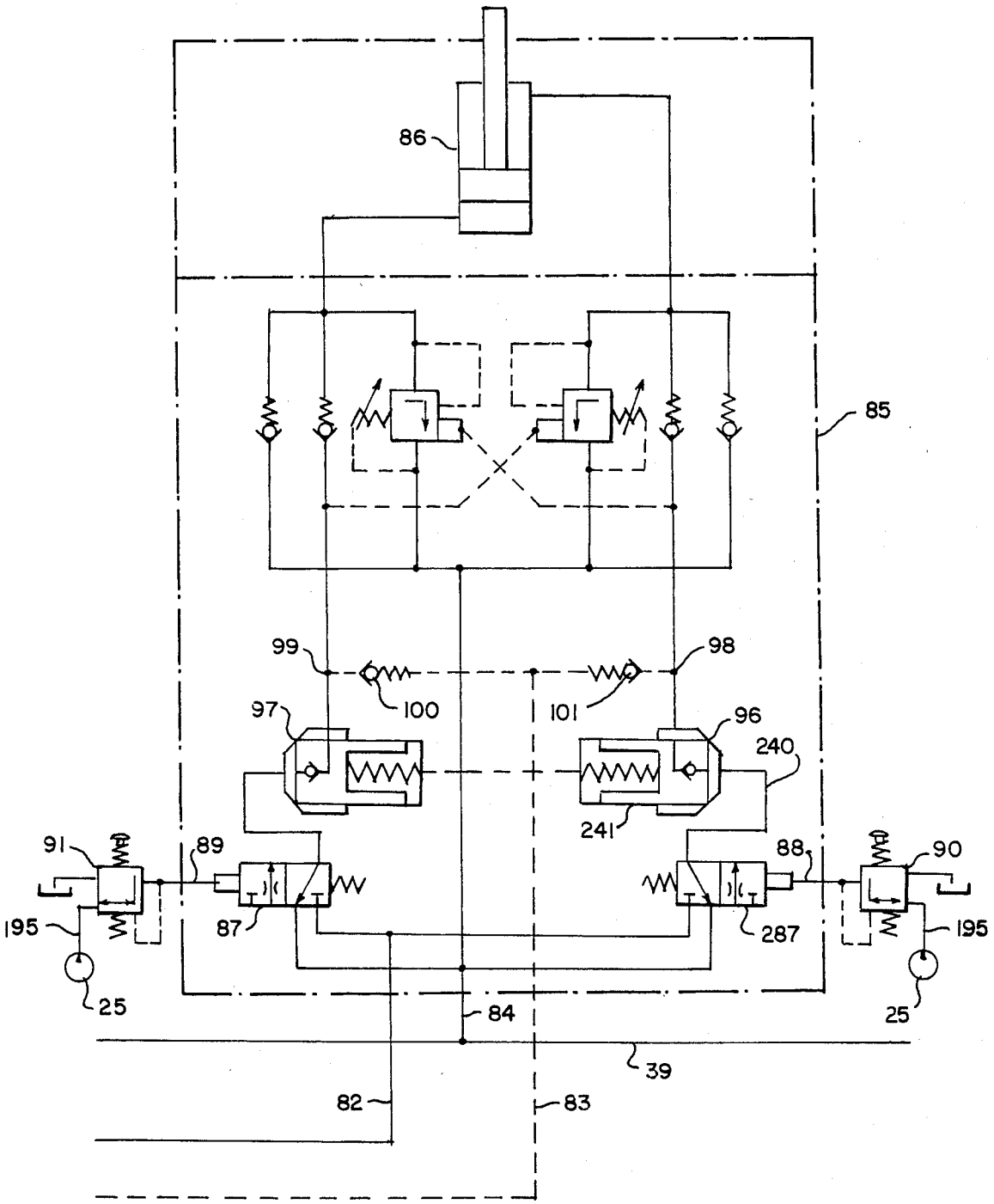
FIG. 7, 8 and 9 show an overall control unit with the assigned consumers thereto.
Figure 8:
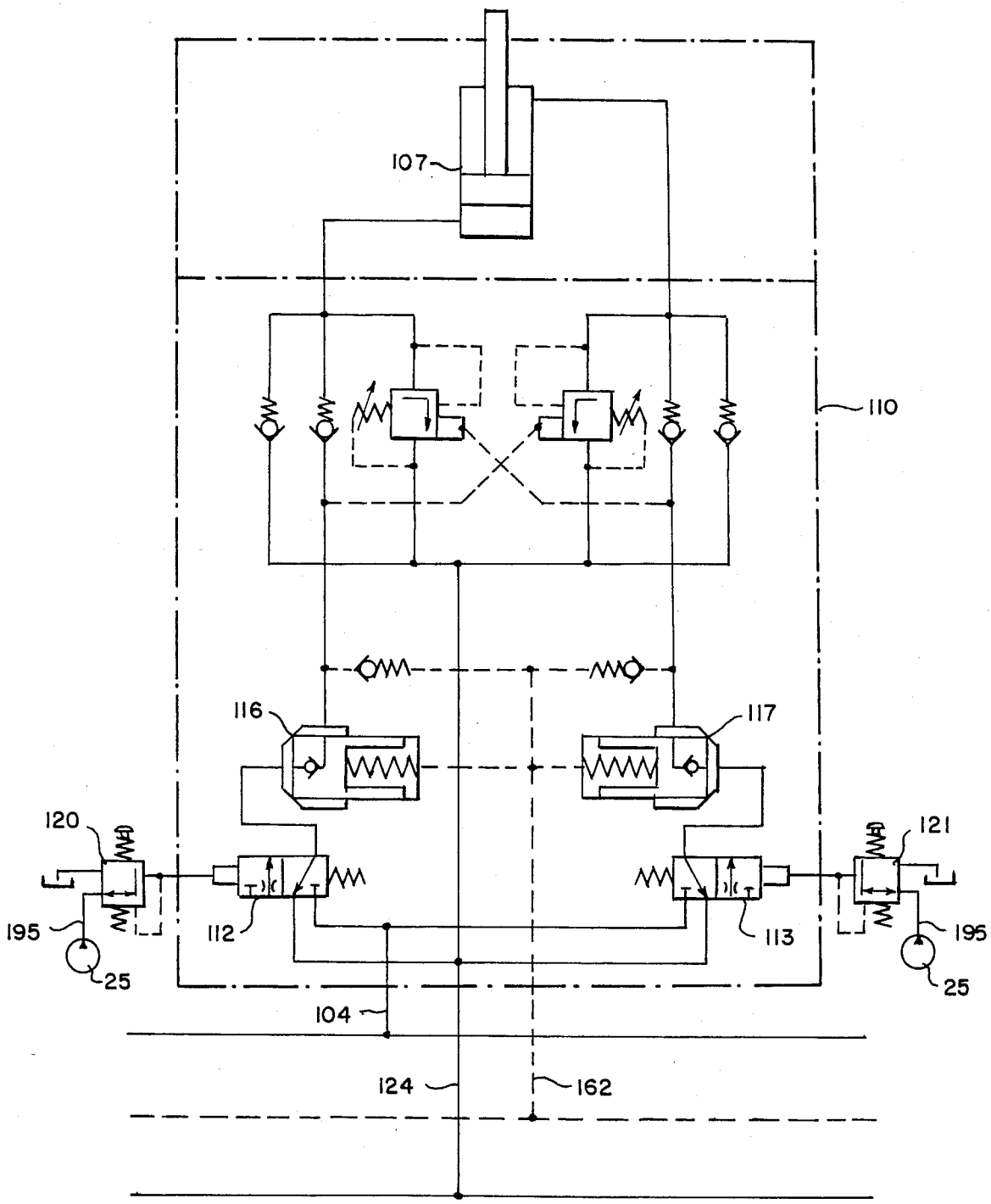
Figure 9:
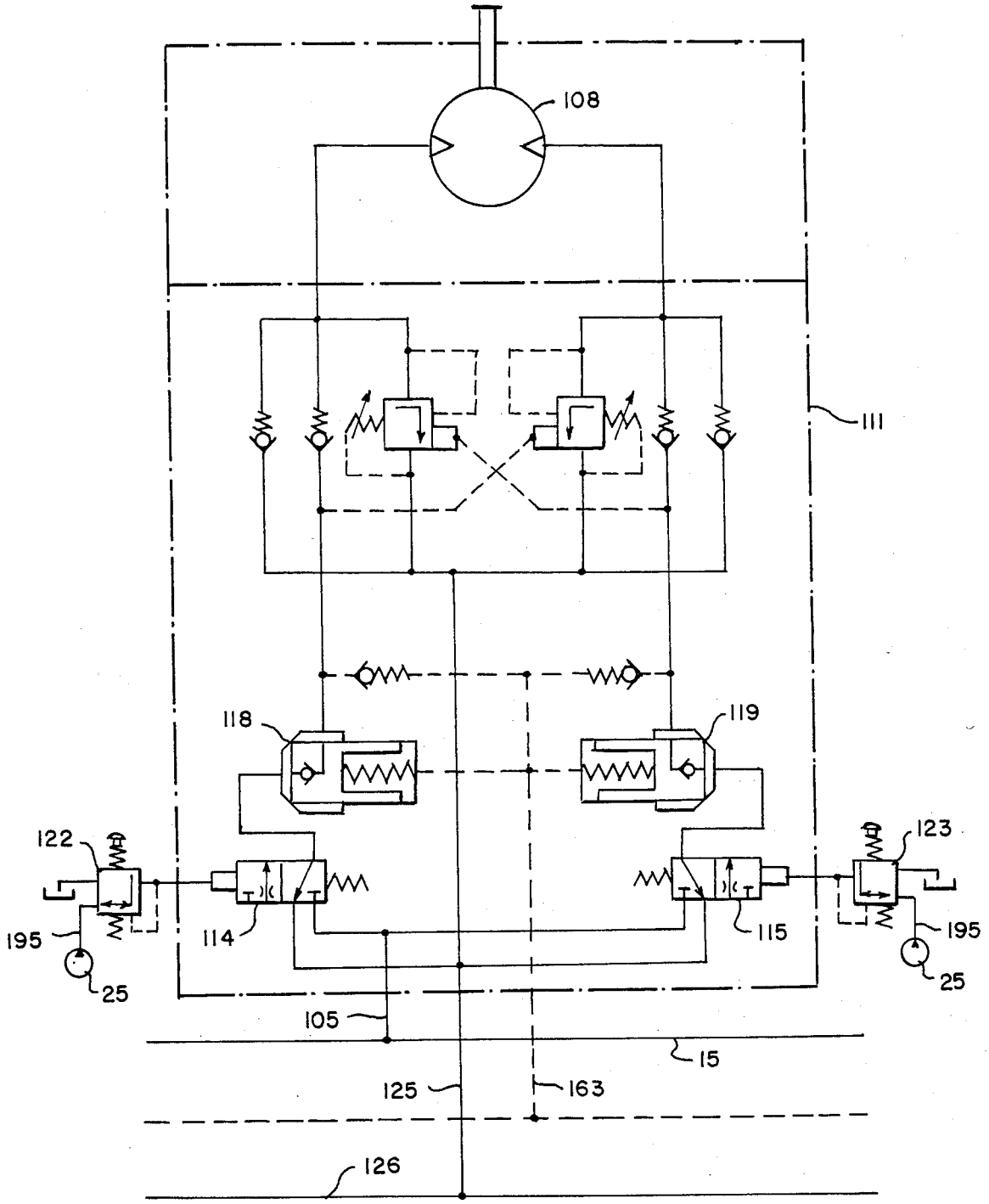
Figure 10:
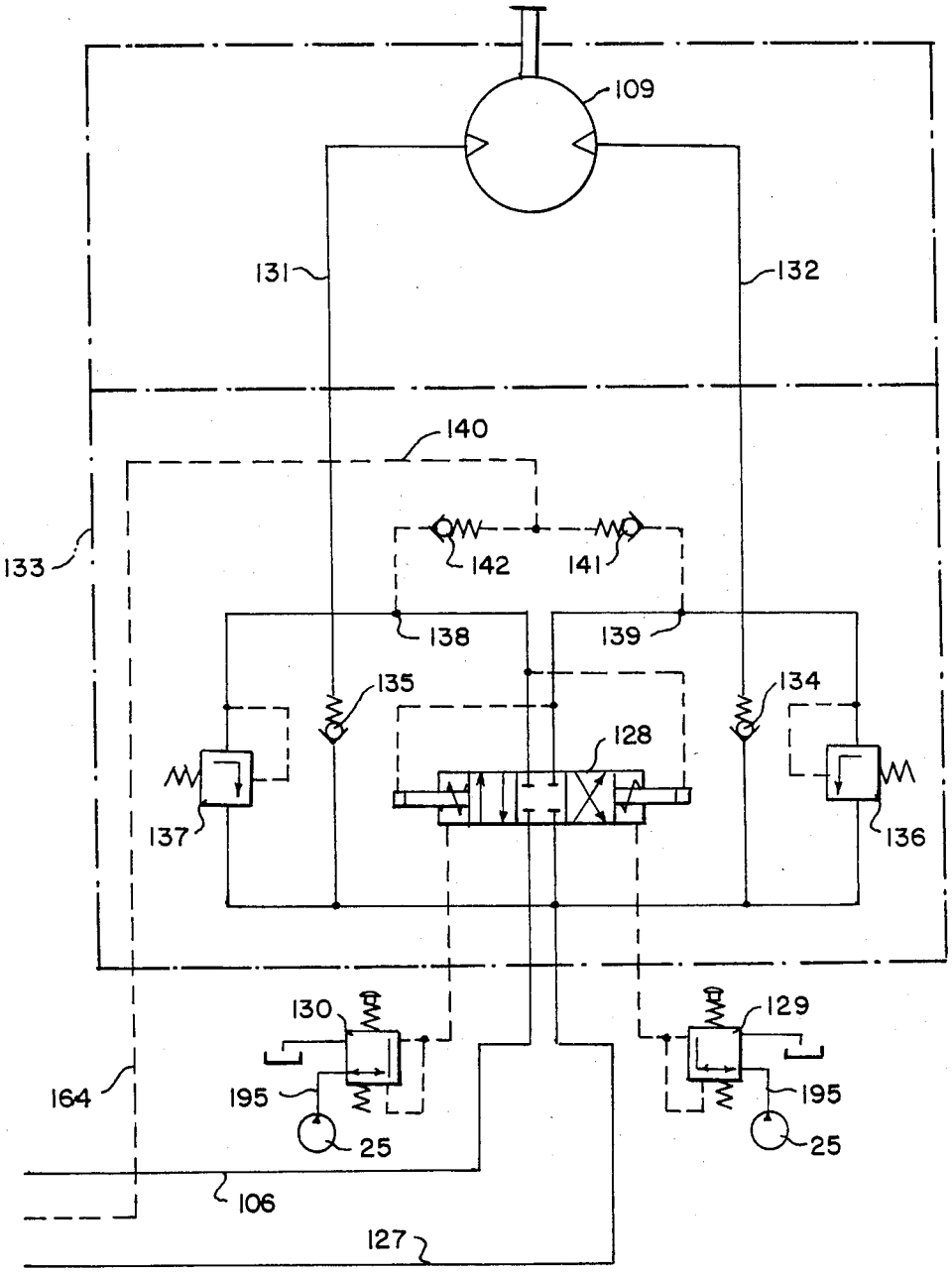
FIG. 10 shows the circuit diagram for an embodiment with constant pressure regulation.

Referring to the drawings, the pumps 3 and 4 are driven by the internal-combustion engine 1 by means of the shaft 2. The adjusting element 5 of the pump 3 is connected with a pump adjusting piston 6, which is capable of sliding in a pump adjusting cylinder 7 and divides it into two pressure chambers 8 and 9. Pump 3 feeds into a delivery line 12, from which the pressure chamber 9 is loaded through branch lines 13 and 14; a spring 11 is located in chamber 9. The loading of pressure chamber 8 is regulated through a hydraulically regulated servo control valve 10.

Pump 4 feeds into a delivery line 15. The adjusting element 16 of pump 4 is connected with a pump adjusting piston 17, which is capable of sliding in a pump adjusting cylinder 18 and divides it into two pressure chambers 19 and 20, in which case a spring 21 is located in pressure chamber 20. This chamber 20 is connected through a branch line 321 and another branch line 22 to the delivery line 15. The loading of pressure chamber 19 is regulated through a hydraulically controlled servo control valve 23. Both pumps 3 and 4 are located in a common housing 24.

Two additional pumps 25 and 26, designed as constant pumps, are driven by the shaft 2 (pump 26 can however also be driven by a secondary power take-off of the engine 1 in another construction form).

A delivery branch line 28 branches off from the delivery line 12; it leads to a component control unit 27 in which the branch delivery line 28 is divided into two component lines 29 and 30. Each of the component lines 29 and 30 leads to a single-edge servo valve spool 31 or 32, where spool 31 is regulated hydraulically and is loaded with pressure through a pressure pick-off control line 33 by an arbitrarily actuatable control pressure pick-off 92 located in the operator's cab of the dredger. In precisely the same manner, the hydraulically regulated single-edge servo valve spool 32 is loaded with control pressure through a pressure pick-off control line 34, where the latter leads to another control pressure pick-off 93 that can be actuated arbitrarily and is also located in the operator's cab. The single-edge servo valve spools 31 and 32 act as metering restrictors, through which a throttled stream is conveyed from the component line 29 to the line 35 or from the component line 30 to the line 36. In the other position, spool 31 connects line 35 with return line 37 and, in the same manner in the other position, spool 32 connects lines 36 and 38, in which case the two return lines 37 and 38 lead jointly to the branch return line 39.

The line 35 leads to a parallel-connecting restrictor 40 with a slide valve 41, whose back side is loaded by a spring 42 and by the control pressure present in a control pressure line 53. A line 43 comes from the parallel-connnecting restrictor 40 and it separates into two lines 44 and 45, which lead to a pressure chamber 46 or 47 of the two parallel-connected working cylinders 48 and 49 provided in the dredger for "lifting".

Analogously, line 36 leads to a parallel-connecting restrictor 50 with a slide valve 51, the back side of which is loaded by a spring 52 and by the pressure present in a control line 53. A line 53 comes from the parallel-connecting restrictor 50 and it is divided into two lines 54 and 55, line 54 of which leads to the pressure chamber 56 of the working cylinder 48 and line 55 leads to the pressure chamber 57 of the working cylinder 49.

A check valve 58 opening toward the working cylinder 48 is located in line 54. A line 59 is connected to line 54 between the check valve 58 and the working cylinder 48; it leads to a regulated relief valve jet 60, whose drain leads through lines 61 and 62 to the component return line 39. A line 63 is also connected to line 54 between the check valve 58 and the working cylinder 48; a resuction check valve 64 is located in line 63 and is also connected to line 62.

A check valve 68 is located in line 44 in an analogous manner and a line 65 is connected between it and the working cylinder 48; a resuction check valve 66 is located in line 65 and it is also connected to line 62. A line 69 is also connected to line 44 between the check valve 68 and the working cylinder 48; it leads to a hydraulically regulated relief valve jet 70, whose drain line 71 is connected to the line 62. The control pressure chamber of the relief valve jet 70 is connected through line 72 to line 54 in front of the check valve 58 and in precisely the same manner the control pressure chamber of the relief valve at 60 is connected through line 73 to line 44 in front of the check valve 68. If the line 54 is carrying pressure, the control pressure chamber of the relief valve jet 70 is loaded by this pressure and thus relieves the relief valve jet of the spring pressure so that it opens at a more or less slight pressure in line 44 and, inversely, the same is true for relief valve jet 60 if line 44 carries pressure in front of the check valve 68.

These valves 58, 64, 60, 70, 68, 66 are combined into one control unit 74, which is attached directly to the working cylinder 48.

An analogously identical valve arrangement is provided in the control unit 75, which is attached to the working cylinder 49.

A line 76 is connected inside of the component control unit 27 to line 53 and it leads to a check valve 77. A line 78 is also connected to line 43 and it leads to a check valve 79. The two check valves 77 and 79 are connected on the other side to the component control pressure line 80, to which the pressure chambers beyond the slide valves 41 and 51 are connected.

A relief check valve 94 opening toward line 35 is located in the slide valve 41. In precisely the same manner, a relief check valve 95 opening toward line 36 is located in the slide valve 51. The control pressure line 80 leads to an overall control pressure line 81, to which a branch control pressure line 83 is connected. A branch line 82 is connected to the delivery line 12. The two branch lines 82 and 83 lead to an overall control unit 85, from which a return line 84, which is connected to the return line 39, departs. The overall control unit 85 is attached to the working cylinder 85*a*, which actuates the shovel of the dredger. The overall working arrangement of the overall control unit 85 is analogous to the sum of the component control unit 27 and the control unit 74. Two single-edge servo valve spools 86 and 87 are provided, of which spool 86 is loaded through a pressure pick-off control pressure line 88 by an arbitrarily actuatable control pressure pick-off 90, which is located in the vicinity of the control pressure pick-offs 92 and 93, which load or act upon the pressure pick-off control pressure lines 33 and 34. Accordingly, spool 87 is regulated by means of a pressure pick-off control pressure line 89, which in turn also leads to an arbitrarily actuatable control pressure pick-off 91, which is located in the vicinity of the control pressure pick-offs 90, 92, 93.

A parallel-connecting restrictor 96 or 97 is connected beyond the two single-edge servo valve spools 86 and 87 which act as metering restrictors; beyond the restrictor 96 or 97 a branch line leading to the component control pressure line 83 and with a check valve 100 or 101 branches off at a connection point 98 or 99.

The return line 39 leads to a main return line 102, which leads directly into the housing 24 of the pumps and to which a prestressed reservoir tank 103 is connected.

Branch lines 104, 105, and 106 branch off from the delivery line 15 coming from the pump 4, of which line 104 leads to a working cylinder 107 for bending the shovel arm, line 105 leads to a hydraulic motor 108 for traveling, and line 106 leads to a hydraulic motor 109 for swivelling the dredger. The overall control units 110 and 111 are designed in the same manner as the overall control unit 85. This means that they contain two single-edge slide valves each, 112 and 113 or 114 and 115, and a parallel-connecting restrictor 116, 117, 118, or 119 is subsequently connected, in which case the single-edge servo valve spool 112 is loaded from an arbitrarily actuatable control pressure pick-off 120 and spool 113 is loaded from a control pressure pick-off 121, spool 114 is loaded from a control pressure pick-off 122 and spool 115 is loaded from a control pressure pick-off 123. The return line components 124 and 125 coming from the overall control devices 110 and 111 all lead to a branch return line 126, which is connected to the main return line 102. The same is true for return line 127. The lines 106 and 127 are connected to a 4-connection/3-position valve 128, which is controlled hydraulically by the two control pressure pick-offs 129 and 130 and selectively connects either the one connection 131 of the hydraulic motor 109 with the delivery line 106 and the other connection 132 of motor 109 with the return line 127 or, inversely, delivery line 106 with the connection 132 and the return line 127 with the connection 131. An additional control unit 133 is also provided here; it is attached directly to the hydraulic motor 109, and two check valves 134 and 135 and two relief valve jets 136 and 137 and connections 138 and 139 for a control pressure line 140 are provided in it, in which case check valves 141 and 142 are located between the control pressure line 140 and the connections 139 and 138.

The overall control pressure line 81 assigned to pump 3 continues into the control pressure line 150, which leads to a branch line 152, in which a restrictor 153 is located and which leads to a pressure chamber of the hydraulically controlled servo control valve 10. The opposite pressure chamber is connected through branch line 154 to line 14, which is loaded with the pressure in the delivery line 12 of pump 3.

A flow regulator 155 is connected to line 150 also; its discharge leads into the inner chamber of the housing 24 of pumps 3 and 4.

A relief valve jet 157 is connected to line 152 between the restrictor 153 and the control pressure chamber of the servo control valve 10.

A line 158 comes from line 13; it leads to a connection 159 of the servo control valve 10 so that pressure medium delivered by the pump 3 through this line 158 and connection 159 can be conveyed through the delivery line 12, lines 13, 158, and the connection 159 through the servo control valve 10 into the pressure chamber 8.

Between the line 158 and line 150 there is a connecting line 160 in which a by-pass restrictor 161 is located (this line 160 with the restrictor 161 can be omitted if the servo control valve 10 is designed with a sufficiently large negative overlap so that when valve 10 is in the neutral position a partial stream flows continously through lines 12, 13, 158 and the connection 159 to the pressureless tank 156 or preferably into the inner chamber of the housing 24 of pumps 3 and 4. This solution has the advantage that the flow regulator 155 does not additionally need to be adjusted to the stream flowing through the by-pass restrictor 161).

The control pressure component lines 162, 163, and 164 come from the control units 110 and 111 and from the control device 133 and are connected to the overall control pressure line 165, which continues into the line 166, to which the line 167 with the restrictor 168 is connected and to which the flow regulator 169 is connected. The line 170 coming from the restrictor 168 leads to a pressure chamber of the hydraulically regulated servo control valve 23, where its opposite pressure chamber is connected to line 22 through connection 171. A relief valve jet 172 is connected to line 170.

The connection 173 of the servo control valve 23 is connected through line 174 to line 321. A connecting line 175 is located between the lines 174 and 166 and it contains a by-pass throttle 176 (the same is true here as stated with regard to line 160 and restrictor 161).

A coupling control line 177 is connected to the overall control pressure line 81 and a coupling control line 178 is connected to the overall control pressure line 165, in which case these two control lines lead to the coupling unit 179. A 4-connection/2-position valve 182 is located in the coupling unit 179; it is hydraulically regulated and has two control pressure chambers on each side, where a control pressure chamber of the same size on the other side is assigned to each control pressure chamber on the one side. It is not necessary here, however, that the two control pressure chambers on one side have the same diameter. A branch line 180 leads from the delivery line 12 into the coupling unit 179; likewise, a branch line 181 leads from the delivery line 15 into the coupling unit 179. The two lines 180 and 181 are connected in such a manner to the 4-connection/2-way valve 182 that in its position shown the lines 180 and 181 are connected together and in its other position these lines are shut off. The control pressure lines 177 and 178 are connected to the two other connections of the 4-connection/2-way valve 182 in such a manner that in the position of the valve slide shown the lines 177 and 178 are connected together.

Two relief valve jets 184 and 185 are also located in the coupling unit 179, of which jet 184 serves to protect the delivery line 12 and is connected to it through line 180, while jet 185 serves to protect the delivery line 15 and is connected to it through line 181.

The line 180 loaded with the delivery pressure of pump 3 and the line 177 carrying the control pressure assigned to pump 3 are connected on opposite sides to pressure chambers of identical size, and the line 181 loaded by the delivery pressure of pump 4 and the line 178 loaded with the control pressure assigned to pump 4 are connected to pressure chambers of the 4/2-way valve 182, of identical size and located on opposite sides, such that the two lines 177 and 178 loaded with control pressure are connected on the side on which the pressure spring 186 is located.

The constant pump 25 draws through line 187 from the housing 24 of pumps 3 and 4 and delivers into a line 188, which leads to an adjustable restrictor 189, whose adjusting element 190 is in operating connection with the adjusting element of the engine 1. A relief valve jet 193 is connected in front of the restrictor 189 to line 188 through a line 191, in which a filter 192 is located; its drain is connected to a line 194, which in turn is connected to the line 195 that forms the continuation of ine 188 beyond the restrictor 189, and which leads to additional consumers (not shown in the drawing).

A regulated relief valve jet 196 is also connected to line 194; its control pressure is determined through line 197 by the pressure in front of the restrictor 189. The line 198 coming from the relief valve jet 196 leads to a restrictor 199 and the line 200 coming form the latter leads through a relief valve jet 201 to the tank 156. Another relief valve jet 202 is connected arallel to the consecutively connected relief valve jet 196 and restrictor 199; it maintains the pressure constant in front of the relief valve jet 196. The essential point is that the pressure gradient at the restrictor 189 regulates the relief valve jet 196, which in turn regulates the stream to the restrictor 199.

A maximum-pressure control line 203 branches off from line 198 between the relief valve jet 196 and the restrictor 199 and a second maximum-pressure line 204 branches off from line 200. Line 203 branches into two lines 205 and 206, which empty into a control pressure chamber of the servo control valve 10 or 23, i.e., on the same side on which the latter is loaded by the delivery pressure of the assigned pump 3 or 4. Two lines 207 and 208 branch off from line 204; they lead to the other, spring-loaded side of the hydraulically controlled servo control valve 10 or 23.

The mode of operation is as follows: When the engine 1 is running and is driving the pumps 3, 4, 25, 26 and none of the control pressure pick-offs 93, 92, 91, 90, 120, 121, 122, 123, 130, 129 are actuated, the pumps are in the zero-stroke position and do not deliver. No consumer is loaded. Now if the control pressure pick-off 92 is actuated, the single-edge servo valve spool 31 is actuated and opens, so that it effects a connection between the delivery line 12 and the line 44 to the working cylinder 48, in which case the parallel-connecting restrictor 40 opens. The check valve 79 opens at the same time, so that the line 80 and thus line 81 are also loaded with pressure.

Since the single-edge servo valve spool 31 acts as a metering restrictor, the pressure in line 35 and thus the pressure in line 43 and thus also the pressure in line 78 and lines 80 and 81 are less than the pressure in the branch delivery line 28 and delivery line 12. The pressure in delivery line 12 acts through lines 13, 14, and 154 on one side of the servo control valve 10 and the pressure in the control pressure line 81 acts through lines 150, 151, 152 on the other side of this servo control valve, on which the spring also acts. The spring is so designed here that the servo control valve 10 responds at a quite specific pressure difference between the pressures in lines 154 and 152, e.g., to a presssure difference of 20 bar. As a result, the adjusting element 5 of pump 3 is adjusted by means of the servo control valve 10 through the pump adjusting piston 6 such that it delivers a stream that produces this prescribed pressure gradient at the single-edge servo valve spool 31, which acts as a metering restrictor. That is, if the setting of the single-edge servo valve spool 31 is changed by modifying the setting of the control pressure pick-off 92, the pump 3 will also be adjusted to a different delivery stream, that is, such that the prescribed pressure gradient again develops at this single-edge servo valve spool 31 which acts as a metering restrictor.

The parallel-connecting restrictors 40, 50, 96 or 97 and 116 or 117 have the following mode of operation: If two control pressure pick-offs assigned to two different consumers are simultaneously actuated, e.g., pick-offs 92 and 90, two single-edge slide valves, 31 and 86 in the said case, are simultaneously opened and thus two consumers, here the two working cylinders 48 and 49 and also the working cylinder 86, are connected with the same pump 3. The same pressure acts here in the two working cylinders 48 and 49. However, it is unlikely that the same pressure also acts in the working cylinder 86. Rather, one of the consumers will be more highly loaded and thus require a higher pressure. Assuming that the pressure in working cylinder 86 is higher than the pressure in working cylinders 48 and 49, then there is a higher pressure at the branch point 98 than in the line 43, with the result that the check valve 79 will be closed and the control line system 80, 83 will be loaded by the pressure present at the branch point 98 through the opening of the check valve 101. Because the back sides of the slide valves 41 and 241 are also loaded from this control line system, but different pressures prevail in front of this slide valve in the lines 35 or 240, a different throttling effect will be produced at the restrictors 40 and 96, i.e., such a high pressure gradient will be produced in the consumer 48, 49, which produces the lower pressure, through this parallel-connecting restrictor 40 that such a high pressure will be produced in front of this parallel-connecting restrictor 40 in line 35 and thus in line 28 and thus in line 12 and thus in line 82, as it is required by consumer 86, in which case a correspondingly lesser throttling action will be produced at the parallel-connecting restrictor 96 due to the pressure in line 240 under the action of the control pressure in line 83, since with this pressure the consumer pressure, which acts on the slide valve 241, is sufficiently high to open the parallel-connecting restrictor 96 completely so that no pressure gradient develop as at it.

This arrangement of the parallel-connecting restrictors, which are acted upon in common by the same control pressure on the back side, has the essential advantage that if two consumers together could absorb a larger stream than pump 3 furnishes, the stream furnished by pump 3 is distributed to the two consumers—48, 49 on the one hand and 86 on the other in the present case—proportionally to the opening width of the throttle gaps.

The check valves 58 and 68 act as protection against pipe rupture. This means that if a leak develops in lines 12 or 28 or 82 or any other line connected with them and the pressure escapes, the consumer, which is connected by actuation of the assigned control pressure pick-off and thus opening of the assigned single-edge slide valve, cannot drop back under load. For example, if it is lifted under load and thus the working cylinders 48 and 49 are under pressure and line 12 ruptures, check valve 58 closes. The fluid present in the working cylinders 48 and 49 is thus enclosed and fixed, so that no undesirable movement can occur since the relief valve jet 60 and 70 are also closed, because there is no pressure in lines 53 and 43 and thus the relief valve jets 60 and 70 are not switched in.

However, if the single-edge servo valve spool 31 is opened through the actuation of control pressure pick-off 92, there is pressure in line 43, such that pressure medium flows into the working cylinders 48 and 49 through the lines 43, 44. The pressure present in line 43 also prevails through line 73 in the control pressure chamber of relief valve jet 60 so that the latter is opened. This means that the stream of pressure medium flowing from the pressure chambers 56 and 57 of the working cylinders 48 and 49 can flow off unhindered through line 54 into line 59, relief valve jet 60, lines 61 and 62, and into the component return line 39 and thus into the return line 102. The speed of movement of the pistons in the cylinders 48 and 49 is to be determined by the degree to which the single-edge slide valve 31 is opened. If the pistons in cylinders 48 and 49 attempt to speed up with respect to this stream as a result of external forces, they draw more fluid, with the result that the pressure in line 44 and thus line 43 drops. The pressure in the control pressure chamber of relief valve jet 60 is thus also reduced through line 73, so that it closes to the degree to which the pressure is reduced. This means that a throttling effect is produced in relief valve jet 60, which throttles the stream flowing out of the pressure chambers 56 and 57, so that the speed of movement of the pistons in cylinders 48 and 49 is braked by this throttling action. The relief valve jets 60 and 70 are however also regulated by the pressure in lines 59 and thus 54 or 69 and thus 44. The relief valve jets 60 and 70 thus also act to protect against inadmissibly high pressure in the working cylinders 48 and 49. This means that if an excessive pressure develops as a result of overloading or jerky loading, either relief valve jet 60 or 70, depending on the direction of loading, opens as a result of the excessive pressure, such that these jets 60 and 70 also act as overloading-protection over pressure valves, even if none of the control pressure pick-offs 92 or 93 is actuated.

Especially in the case of pressure medium flowing off through one of the jets 60 and 70, but also in any other case of resuction into one of the pressure chambers 46, 47 or 56, 57 the assigned resuction check valve 64 or 66 opens so that the line 102 can be recharged from tank 103 through the opened resuction check valve 64 or 66 and line 62 and the component return line 39.

If the control pressure pick-off 92 has been actuated and thus the single-edge slide valve 31 has been opened and the line 43 has thus been placed under pressure through the delivery line 12 and lines 28, 29, 35 and now the actuation of control pressure pick-off 92 is ended and thus the single-edge slide valve 31 is brought into the relief position, the parallel-connecting restrictor 40 closes completely. This would have the result that the last-active pressure in line 43 would persist and thus hold the relief valve jet 60 in the open position through line 73. However, if both control pressure pick-offs 92 and 93 are closed, both relief valve jets 60 and 70 should also be closed. Therefore, a check valve 94 opening toward the pump 3 is provided in the slide valve 41; in the said operating state this has the result that the line 43 is relieved through check valve 94 when the parallel-connecting restrictor 40 is closed.

The valves on the other side of the control unit 74 or the corresponding valves in the control unit 85 or 100 or 111 function in an analogous manner.

If such a pressure is produced by action on the control pressure pick-off 92 in the pressure pick-off control pressure line 33 that the single-edge servo valve spool 31 opens quite wide, such a powerful stream will thus be required in lines 29, 35 and thus also 28 and the delivery line 12 that the pump 3 alone can no longer deliver it. In this situation the coupling unit 179 begins to act. As already stated, the spring acting on the servo control valve 10 for regulating the pump 3 through valve 10 is designed so that a specific pressure gradient develops at the single-edge servo valve spool 31 acting as a metering restrictor, e.g., a pressure gradient of 20 bar. The spring 186 at the 4-connection/2-position valve 182 is designed so that this valve responds at a lower pressure gradient, ca. 15 bar, between the delivery line 12 and the control pressure line 81. The 4-connection/2-position valve 182 is designed here so that when the slide valve begins to move, the control lines 177 and 178 are first connected together, with the result that pump 4 is swung out so far that the same pressure prevails in delivery line 15 as in delivery line 12, in which case this pressure is produced in front of the restrictor 176 if no consumer is connected to pump 4. With a further displacement of the slide valve in the 4-connection/2-position valve 182, the lines 180 and 181 are then also connected together through valve 182 so that the delivery stream of pump 4 is also delivered into the delivery line 12 of pump 3 through the 4-connection/2-position valve 182, in which case the pump 4 is now swung out so far that it produces precisely the delivery stream that is required, together with that of pump 3, to produce the pressure gradient, 15 bar here, required at the single-edge servo valve spool 31 acting as a metering restrictor.

Although the consumers are protected directly by the relief valve jets 60, 70 and the corresponding relief valve jets at the other consumers, it is also necessary to protect pump 3 and the entire installation through a relief valve jet that prevents a component of the installation from being damaged by inadmissibly high pressure. For practical reasons, this relief valve jet is incorporated into the coupling unit 179, i.e., the relief valve jet 184 is connected through line 180 to the delivery line 12, and the relief valve jet 185 is connected through line 181 to the delivery line 15 of pump 4 in a corresponding manner in order to protect pump 4. The opening of one of these relief valve jets has the disadvantage that pressure medium is released through it at the highest possible pressure; thus, much energy is lost in this relief valve jet. This is unavoidable in the handling of brief pressure surges, but it is advantageous if this relief valve jet can be prevented from remaining open for a prolonged period of time. For this purpose, the relief valve jet 157 is assigned to pump 3; it is set at such a low pressure that it opens if a pressure prevails in the control line 81 that is below the response pressure of relief valve jet 184 at the metering restrictor formed by the single-edge valve 31 or 32 or 86 or 87, such that relief valve jet 157 opens before relief valve jet 184 does and thus limits the maximum possible pressure in line 152, such that with a slight increase in the pressure in line 154 the servo control valve 10 increases the pressure in pressure chamber 8 of the pump adjusting cylinder 7 and thus sets pump 3 to a smaller stroke and thus a smaller delivery stream, in which case it can be expected that after this regulation process effected by the increase in the control pressure is ended, the pressure in delivery line 12 is reduced as a result of the diminished delivery stream and thus the response of relief valve jet 184 can be prevented.

Analogously, a corresponding relief valve jet 172 is assigned to pump 4; it responds to the pressure in the control pressure line 166 and opens before relief valve jet 185 opens.

With this relief valve jet, however, only a protection against pressure peaks during the regulating process of the pump is achieved. There is no protection against overloading of the engine 1. This is achieved with the maximum-load control mechanism 230. The constant pump 25 delivers through line 188 to the adjustable restrictor 189, whose adjusting element 190 is in operating connection with the adjusting element of engine 1. The line 195 beyond the restrictor leads to the control pressure pick-offs 90, 91, 92, 93 120, 121, 122, 123, 129 and 130. The externally regulated relief valve jet 196 is connected to this line 195; it is influenced through line 197 by the pressure in line 188 in front of the restrictor 189. The relief valve jet 196 is set to the pressure gradient that is to prevail at the restrictor in the case of the prescribed operating r.p.m. If this pressure gradient is present, the relief valve jet 196 is closed. If the pressure gradient is less than prescribed, relief valve jet 196 opens and feeds a stream to the subsequent restrictor 199, at which a pressure gradient now also develops and this pressure gradient is switched through lines 203 and 204 as a pressure difference to the both sides of both servo control valves 10 and 13. As a result, if both pumps 3 and 4 deliver to at least one consumer and the maximum-load control mechanism 230 engages, both pumps 3 and 4 are retracted proportionally, i.e., percentually to the same degree, so that with an overlapping movement of two driven working cylinders the direction of movement resulting from the movement overlapping is not modified. The speeds of movement of two consumers switched in are in the same ratio to each other as the openings of the single-edge servo valve spools that act as metering restrictors. If the r.p.m. of engine 1 now drops as a result of overloading, the pressure gradient at restrictor 189 will decrease and thus relief valve jet 196 will open and a pressure gradient will thus develop at restrictor 199 that acts on both servo control valves 10 and 23 to the same degree. The setting of both pumps 3 and 4 is thus adjusted toward a smaller stroke volume per revolution, but only so far that the pressure gradient at restrictor 199 and the pressure drop at the single-edge slide valve acting as a metering throttle of the consumer switched in maintain the equilibrium. If a tendency to speed up develops at one of the pumps 3 or 4, it immediately receives a countersignal that again equalizes the two pressure gradients. In this manner the pressure gradients at the single-edge servo valve spools of the two consumers, which act as metering throttles, are maintained identical, with the result that the absolute quantities, but not the ratio of the quantities to each other and thus the ratio of the speeds of movement, vary with regard to each other at these single-edge servo valve spools acting as metering throttles.

The relief valve jet 202 serves to protect the constant pump 25. The by-pass relief valve jet 193 also protects the constant pump 25 when the restrictor 189 is closed too far or completely. In this case the oil flows through line 188 line 191, and relief valve jet 193 into line 194.

The pump 26, which delivers to the steering mechanism (not shown in the drawing) of the dredger, is used to charge the pressure reservoir 103. The return from the steering mechanism still has sufficient pressure to charge the reservoir 103. The line 239 coming form the steering mechanism is connected to line 102 for this purpose.

Pump 25 draws from the housing 24, in which the two pumps 3 and 4 are located, in order to assure an exchange of pressure medium in the housing 24. The pressure medium flowing back from the steering through line 239 flows, if excessive, through relief valve jet 201 into the pressureless tank 156.

The volume of the reservoir 103 is dimensioned so that leakage losses and volume differences on both sides of the pistons can be compensated, even with the actuation of several consumers in the same direction.

In the foregoing specification I have set out certain preferred practices and embodiments of my invention, however, it will be understood that this invention may be otherwise embodied within the scope of the following claims.

I claim:

1. In a hydrostatic drive consisting of at least two component systems, each of which has an adjustable pump, a delivery line coming from each pump, a plurality of consumers connected to at least one of said pumps through branch lines, a return line connected to said at least one of said pumps from said consumers and an adjustable restrictor in each of the branch lines, an adjusting element in each restrictor loaded on one side by an arbitrarily regulatable pressue, the improvement comprising means whereby the adjusting element of each restrictor is loaded on the other side by the pressure in the branch line between the restrictor and the consumer, pump adjusting means loaded by the pressure gradient at at least one of the restrictors, a control pressure line leading to the adjusting element of said at least one of the pumps which branches off from the branch line between the restrictor and the consumer, a check valve provided in said control pressure line opening toward the adjusting element of said at least one of the pumps and coupling means including hydraulically controlled valve means for selectively connecting together both the delivery lines and the control pressure lines of each of the pumps whereby when the valve means is in a closed position, each of the delivery lines is separated from each other and each of the control pressure lines is separated from each other and when in an open position, all the delivery lines are connected with each other and all the control pressure lines are connected with each other.

2. A drive according to claim 1 for a consumer that can be acted upon in both directions, wherein the restrictor is a 4-connection/3-position valve, a valve element movable in said valve, the delivery line is connected to one connection, the return line is connected to a second connection, the consumers are connected to the two other connections of the said valve, and a pressure chamber located on both sides of the valve element and each is connected with an arbitrarily actuatable control pressure pick-off, and a second pressure chamber is located on each side of the valve element connected with the branch line between the restrictor and the consumer, which is under pressure when the valve element is set toward this side.

3. A drive according to claim 2, characterized in that a by-pass line is provided between the strictor and the consumer, coming from each of at least two of the branch lines, and it is connected to the return line and a check valve opening toward the consumer is located in it.

4. A drive according to claim 2, characterized in that a drain line is connected to each of the two branch lines connected with the consumer and coming from the 4-connection/3-position valve that forms the restrictor, in which drain line a relief valve jet regulated by the pressure in the branch line is located.

5. A drive according to claim 1 or 2 or 3 or 4 wherein the restrictor and at least one of the valves are combined into one control unit that is located in the vicinity of the consumer.

* * * * *

UNITED STATES PATENT AND TRADEMARK OFFICE

CERTIFICATE OF CORRECTION

PATENT NO. : 4,665,699

DATED : May 19, 1987

INVENTOR(S) : ALFRED KRUSCHE

It is certified that error appears in the above-identified patent and that said Letters Patent is hereby corrected as shown below:

Column 1, line 47, change "ad3usting" to --adjusting--.

Column 4, line 30, change "at" to --jet--.

Column 4, line 62, change "working" to --switching--.

Column 7, line 14, change "ine" to --line--.

Column 7, line 23, change "arallel" to --parallel--.

Column 11, line 68, after "188" insert --,--.

Column 12, line 32, change "pressue" to --pressure--.

Signed and Sealed this

First Day of December, 1987

*Attest:*

DONALD J. QUIGG

*Attesting Officer*

*Commissioner of Patents and Trademarks*